US007200885B1

(12) United States Patent
Thomas

(10) Patent No.: US 7,200,885 B1
(45) Date of Patent: Apr. 10, 2007

(54) COMBINATION SCISSORS AND LIGHTER FOR CUTTING AND SEALING BRAIDED SYNTHETIC HAIR

(76) Inventor: Joyce Elizabeth Thomas, 81 Lilac St., New Haven, CT (US) 06511

( * ) Notice: Subject to any disclaimer, the term of this patent is extended or adjusted under 35 U.S.C. 154(b) by 0 days.

(21) Appl. No.: 11/104,242

(22) Filed: Apr. 11, 2005

(51) Int. Cl.
*B26B 11/00* (2006.01)
*B26B 13/22* (2006.01)

(52) U.S. Cl. ..... 7/158; 30/140

(58) Field of Classification Search ..... 7/158; 30/140; 606/28, 174, 165
See application file for complete search history.

(56) References Cited

U.S. PATENT DOCUMENTS 1,456,639 A * 5/1923 Lagier ..... 606/28
1,763,894 A * 6/1930 Lagier ..... 606/28
4,037,276 A 7/1977 Brinker
4,046,148 A * 9/1977 Meador ..... 606/28
4,485,507 A 12/1984 Kantwerk
5,079,801 A 1/1992 Peterson
5,097,599 A 3/1992 Hasegawa
5,300,083 A * 4/1994 Lin et al. ..... 606/165
5,309,640 A * 5/1994 Caron ..... 30/140
5,653,525 A * 8/1997 Park ..... 362/119
5,659,957 A * 8/1997 Fujita ..... 30/124
5,783,800 A * 7/1998 Thompson et al. ..... 219/225
5,827,281 A * 10/1998 Levin ..... 606/51
5,857,268 A * 1/1999 Park ..... 30/146
5,964,758 A * 10/1999 Dresden ..... 606/45
6,061,912 A * 5/2000 Gazaway ..... 30/140
6,142,769 A * 11/2000 Walker ..... 431/253
6,247,236 B1 * 6/2001 Johnson ..... 30/140

* cited by examiner

*Primary Examiner*—D. S. Meislin
(74) *Attorney, Agent, or Firm*—Michael I. Kroll

(57) ABSTRACT

Apparatus 10 provides a combination scissor 18 and lighter 20 for the cutting and sealing of braided synthetic hair 14 made up of a cutting implement having two blades 22, 24 joined by a swivel pin 26 having handles 28, 30 at one distal end. One of the handles 28 has a chamber 36 therein for storing a quantity of a combustible substance therein. The chamber 36 has an input valve 44 for refilling the chamber and an output valve communicating with a conduit 46 extending through the blade 22 to the other distal end. Also located within the handle 28 and extending therefrom is an igniter switch 40 which when depressed opens the output valve on the chamber permitting the combustible substance to escape through the conduit to the distal end 32 of the blade 22. Work in concert with the opening of the valve is an igniter to send a spark to the end of the distal end 32 of the blade 22 whereby the combustible fluid is ignited.

8 Claims, 7 Drawing Sheets

COMBINATION SCISSORS AND LIGHTER FOR CUTTING AND SEALING BRAIDED SYNTHETIC HAIR

BACKGROUND OF THE INVENTION

1. Field of the Invention

The present invention relates generally to haircutting scissors and, more specifically, to a combination scissors and lighter for use when braiding synthetic hair. The present invention overcomes the difficulties encountered by someone that is adding braided synthetic hair extensions to another person. Once the synthetic hair is braided to the desired length it is then cut and the resulting loose strands are then burned to seal the end and prevent the fraying or unraveling of the braid. The hairdresser must hold the end of the braided section in one hand to keep the braid intact and then use the other hand to cut the ends of the braid with a scissor which then has to be put down in order to pick up a lighter to apply a flame to the loose ends in order to seal the braid. This method is not only awkward but time-consuming especially when a great number of braids must be cut and sealed. The present invention overcomes the shortcomings of the prior art by providing a scissor lighter combination that will give the hairdresser one tool with which to perform both the cutting and sealing of the braid. The present invention provides a combination scissor and lighter for the cutting and sealing of braided synthetic hair comprising a cutting implement having two blades joined by a swivel pins having handles at one distal end. One of the handles has a chamber therein for storing a quantity of a combustible substance therein. The chamber has an input valve for refilling the chamber and an output valve communicating with a conduit extending through the blade to the other distal end. Also located within the handle and extending therefrom is an igniter switch which when depressed opens the output valve on the chamber permitting the combustible substance to escape through the conduit to the distal end of the blade. Working in concert with the opening of the valve is means for sending an igniter spark to the end of the distal end of the blade whereby the combustible fluid is ignited.

2. Description of the Prior Art

There are other scissor devices designed as multifunctional tools. Typical of these is U.S. Pat. No. 5,097,599 issued to Hasegawa on Mar. 24, 1992.

Another patent was issued to Peterson on Jan. 14, 1992 as U.S. Pat. No. 5,079,801. Yet another U.S. Pat. No. 4,485,507 was issued to Kantwerk on Dec. 4, 1984 and still yet another was issued on Jul. 26, 1977 to Brinker as U.S. Pat. No. 4,037,276.

U.S. Pat. No. 5,097,599

Inventor: Yoshinobu Hasegawa

Issued: Mar. 24, 1992

An emergency escape tool is proposed for escaping from a car when an accident happens. Scissors for cutting a seat belt and a spike are provided. The spike is held at and retractably protrudes from a handle of the scissors. A tip of the spike is pressed against a window glass. A spike driver is housed in the handle. The spike driver usually urges the spike in the protruding direction. When the spike pressed against the window is displaced inwardly, the spike driver accumulates a compression force corresponding to the displacement. According to the accumulated compression force, the spike is promptly pressed toward the protruding direction so as to break the window glass.

U.S. Pat. No. 5,079,801

Inventor: Larry Peterson

Issued: Jan. 14, 1992

Protection scissors comprising blades with sharpened outer edges and handles functioning as brass knuckles.

U.S. Pat. No. 4,485,507

Inventor: Karl-Heinz Kantwerk

Issued Dec. 4, 1984

A combination tool in the form of scissors with two double levers connected to one another in an articulated fashion has cooperating cutting edges on one side of the lever arm and handles on the other, with the lever arms carrying the handles being formed in a hammer head fashion and the lever arms carrying the opposed cutting edges having a longitudinal opening to receive the lever arm carrying the cutting edge and with both lever arms having a closed cross-section in the closed position.

U.S. Pat. No. 4,037,276

Inventor: Reiner G. Brinker

Issued: Jul. 26, 1977

A multipurpose combination tool based upon handoperated shears is provided having special utility in rescue work. The shears comprise blade portions, a bevel edged recess for severing cables, an angled juncture associated with said blade portions to facilitate the cutting of thick sheet materials, a protective stub at the terminus of said blade portions, and other features.

While these multifunctional scissors may be suitable for the purposes for which they were designed, they would not be as suitable for the purposes of the present invention, as hereinafter described.

SUMMARY OF THE PRESENT INVENTION

The present invention overcomes the shortcomings of the prior art by providing a scissor lighter combination that will give the hairdresser one tool with which to perform both the cutting and sealing of the braid. The present invention provides a combination scissor and lighter for the cutting and sealing of braided synthetic hair comprising a cutting implement having two blades, joined by a swivel pin having handles at one distal end. One of the handles has a chamber therein for storing a quantity of a combustible substance therein. The chamber has an input valve for refilling the chamber and an output valve communicating with a conduit extending through the blade to the other distal end. Also located within the handle and extending therefrom is an igniter switch which when depressed opens the output valve on the chamber permitting the combustible substance to escape through the conduit to the distal end of the blade. Working in concert with the opening of the valve are means for sending an igniter spark to the end of the distal end of the blade whereby the combustible fluid is ignited.

A primary object of the present invention is to provide a multi-functional tool comprising a pair of scissors and a lighter.

Another object of the present invention is to provide a pair of scissors having a lighter contained therein.

Yet another object of the present invention is to provide a pair of scissors having a lighter container therein having an igniter switch contained within the handle of the scissors.

Still yet another object of the present invention is to provide a pair of scissors having a lighter contained therein having means for replenishing the lighter fluid.

Yet another object of the present invention is to provide a pair of scissors having a lighter contained therein having the lighter output port located at the terminus of one of the scissor blades.

Additional objects of the present invention will appear as the description proceeds.

The present invention overcomes the shortcomings of the prior art by providing a multifunctional tool comprising a cutting implement having two blades joined by a swivel pins having handles at one distal end. One of the handles has a chamber therein for storing a quantity of a combustible substance therein. The chamber has an input valve for refilling the chamber and an output valve communicating with a conduit extending through the blade to the other distal end. Also located within the handle and extending therefrom is an igniter switch which when depressed opens the output valve on the chamber permitting the combustible substance to escape through the conduit to the distal end of the blade. Working in concert with the opening of the valve is means for sending an igniter spark to the end of the distal end of the blade whereby the combustible fluid is ignited.

The foregoing and other objects and advantages will appear from the description to follow. In the description reference is made to the accompanying drawings, which form a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWINGS

In order that the invention may be more fully understood, it will now be described, by way of example, with reference to the accompanying drawings in which.

LIST OF REFERENCE NUMERALS

Figure 1:
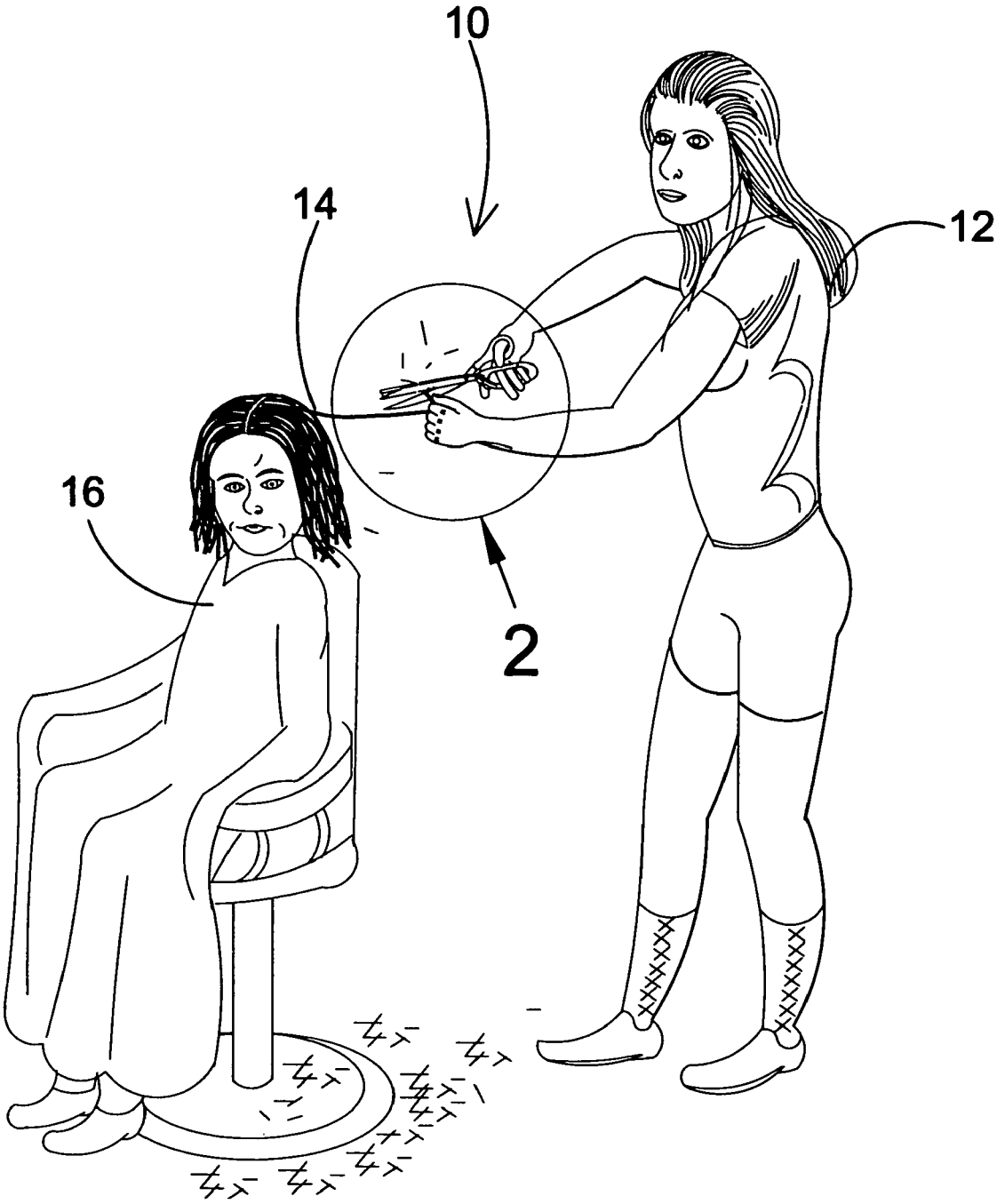
FIG. 1 is an illustrative view of the present invention being used to cut a braided synthetic hair extension.

With regard to reference numerals used, the following numbering is used throughout the drawings.

| | |
|---|---|
| 10 | present invention |
| 12 | user |
| 14 | hair |
| 16 | user |
| 18 | scissor |
| 20 | lighter |
| 22 | blade |
| 24 | blade |
| 26 | pin |
| 28 | handle |
| 30 | handle |
| 32 | flame end |
| 34 | fluid |
| 36 | chamber |
| 37 | combustible substance/fluid |
| 38 | output valve |
| 40 | igniter switch |
| 42 | canister |
| 44 | input port |
| 46 | conduit |
| 48 | means for igniter spark |

DETAILED DESCRIPTION OF THE PREFERRED EMBODIMENT

The following discussion describes in detail one embodiment of the invention (and several variations of that embodiment). This discussion should not be construed, however, as limiting the invention to those particular embodiments, since practitioners skilled in the art will recognize numerous other embodiments as well. For a definition of the complete scope of the invention, the reader is directed to the appended claims.

Turning to FIG. 1, shown therein is an illustrative view of the present invention 10 being used by a user 12 to cut a braided synthetic hair extension 14 of another user 16.

Figure 2:
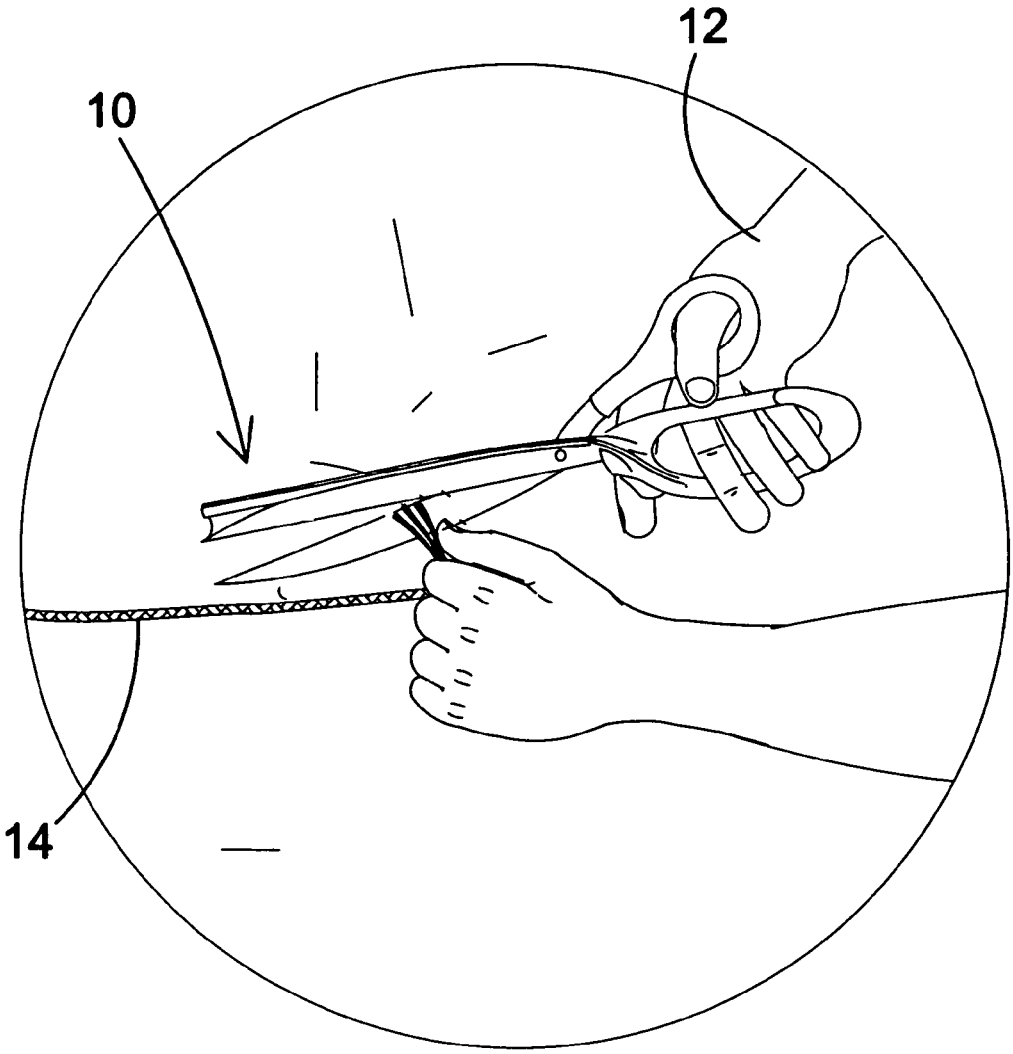
FIG. 2 is a detailed view of the present invention being used to cut a braided synthetic hair extension taken from FIG. 1 as indicated.

Turning to FIG. 2, shown therein is a detailed view of the present invention 10 being used by a user 12 to cut a braided synthetic hair extension 14 taken from FIG. 1 as indicated.

Figure 3:
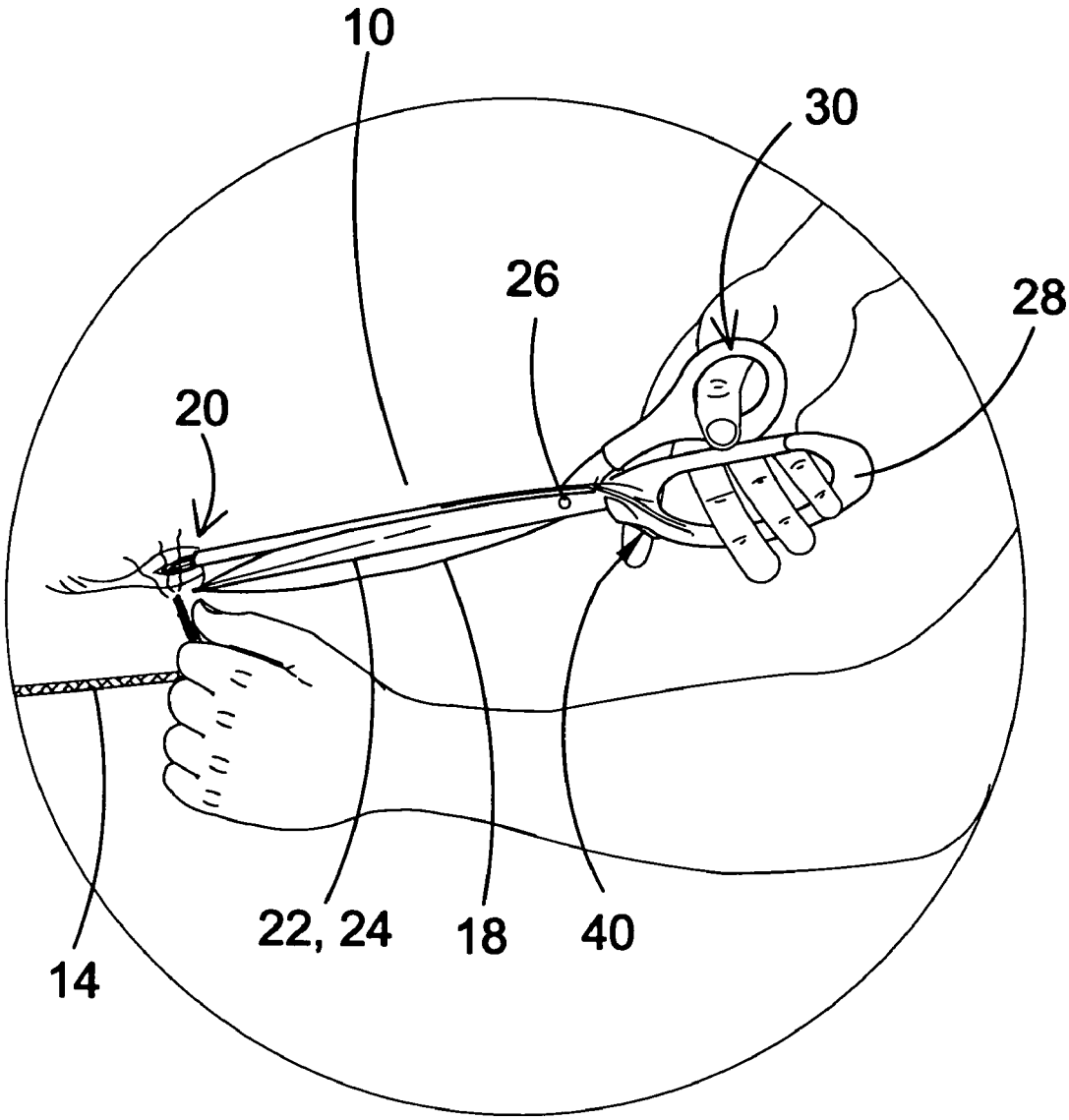
FIG. 3 is a detailed view of the present invention in use as lighter to burn and singe the hair to form a seal to avoid the fraying and unraveling of the braid.

Turning to FIG. 3, shown therein is a detailed view of the present invention 10 in use as lighter to burn and singe the hair 14 to form a seal to avoid the fraying and unraveling of the braid. The present invention 10 provides a combination scissor 18 and lighter 20 for the cutting and sealing of braided synthetic hair 14 comprising a cutting implement having two blades 22, 24 joined by a swivel pin 26 the blades having cutting edges thereon having handles 28, 30 at one distal end. The sharpened cutting edges lie on a common plane when the blades are closed and the pin 26 lies on a substantially central axis of the blades 22, 24. One of the handles 28 has a chamber 36 therein for storing a quantity of a combustible substance therein. The chamber 36 has an input valve for refilling the chamber and an output valve communicating with a conduit extending through the blade to the other distal end. Also located within the handle 28 and extending therefrom is an igniter switch 40 which when depressed opens the output valve on the chamber permitting the combustible substance to escape through the conduit to the distal end 32 of the blade 20. Working in concert with the opening of the valve are means for sending an igniter spark to the end of the distal end 32 of the blade 20 whereby the combustible fluid is ignited.

Figure 4:
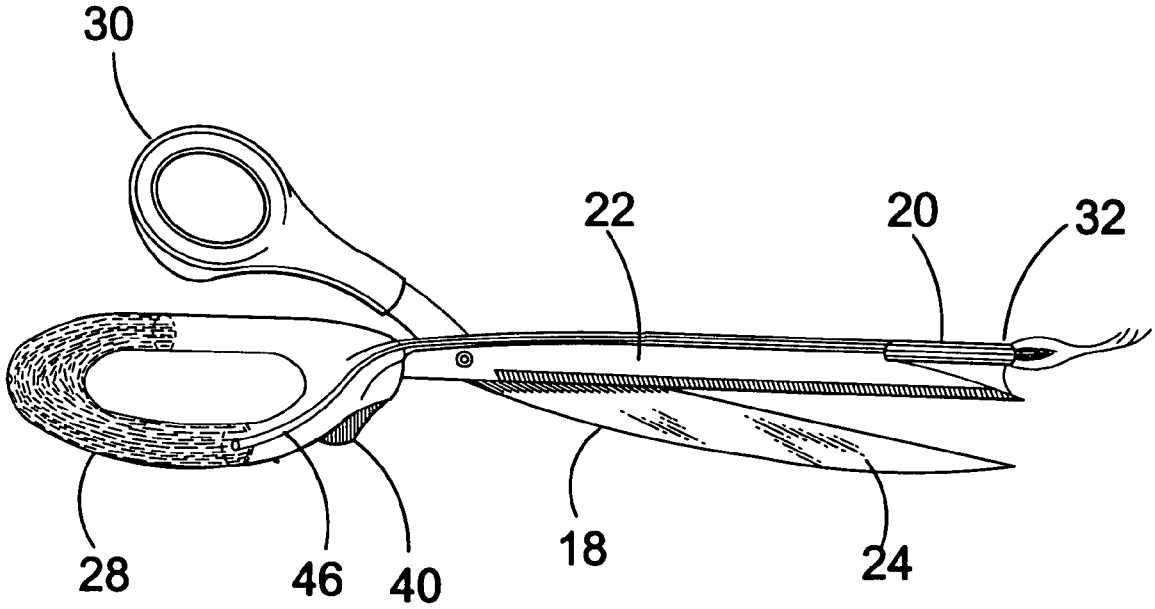
FIG. 4 is a front elevation of the present invention.

Turning to FIG. 4, shown therein is a front elevation of the present invention 10. Shown is the combination scissor 18 and lighter 20 comprising a pair of scissors having handles 28, 30 having an igniter switch 40 located within the forward section of one of the handles 28. When the igniter switch 40 is depressed a valve will be opened causing an amount of gas to escape through conduit 46 to the terminus or flame end 32 of the blade. Also when the igniter switch 40 is depressed a spark will also be generated at the terminus of the blade. Blades 22, 24 have a cutting edge portion which lie on a common plane when the blades are closed.

Figure 5:
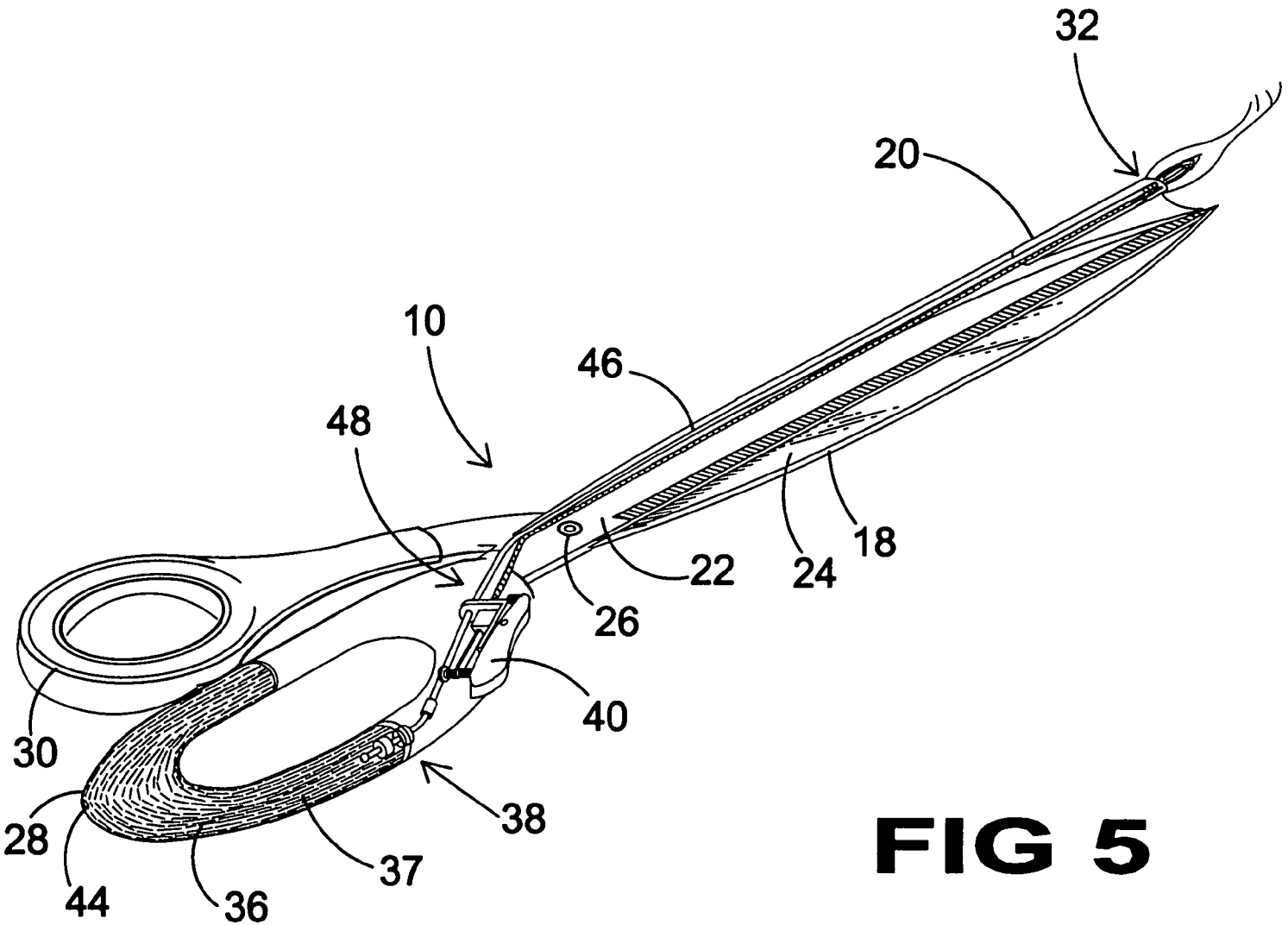
FIG. 5 is a perspective view of the present invention.

Turning to FIG. 5, shown therein is a perspective view of the present invention 10. Shown is a combination scissor 18 and lighter 20 having a pivot pin 26 connecting two blades 22,24. Each blade 22,24 having a handle 28,30 at one distal end. One of the handles 28 has a chamber 36 and forwardly positioned switch 40 which is used to release and ignite the gas at 32. One of the handles 28 has a chamber 36 therein for storing a quantity of a combustible substance therein. The chamber 36 has an input valve 44 for refilling the chamber 36 and an output valve 38 communicating with a conduit extending through the blade 22 to the other distal end. Also located within the handle 28 and extending therefrom is an igniter switch 40 which when depressed opens the output valve 38 on the chamber 36 permitting the combustible substance/fluid 37 to escape through the conduit 46 to the distal end 32 of the blade 20. Working in concert with the opening of the valve 38 are means 48 for sending an igniter spark to the end of the distal end 32 of the blade 20 whereby the combustible fluid 37 is ignited. Switch 40 and means 48 are adjacent the first end of the conduit 46.

Figure 6:
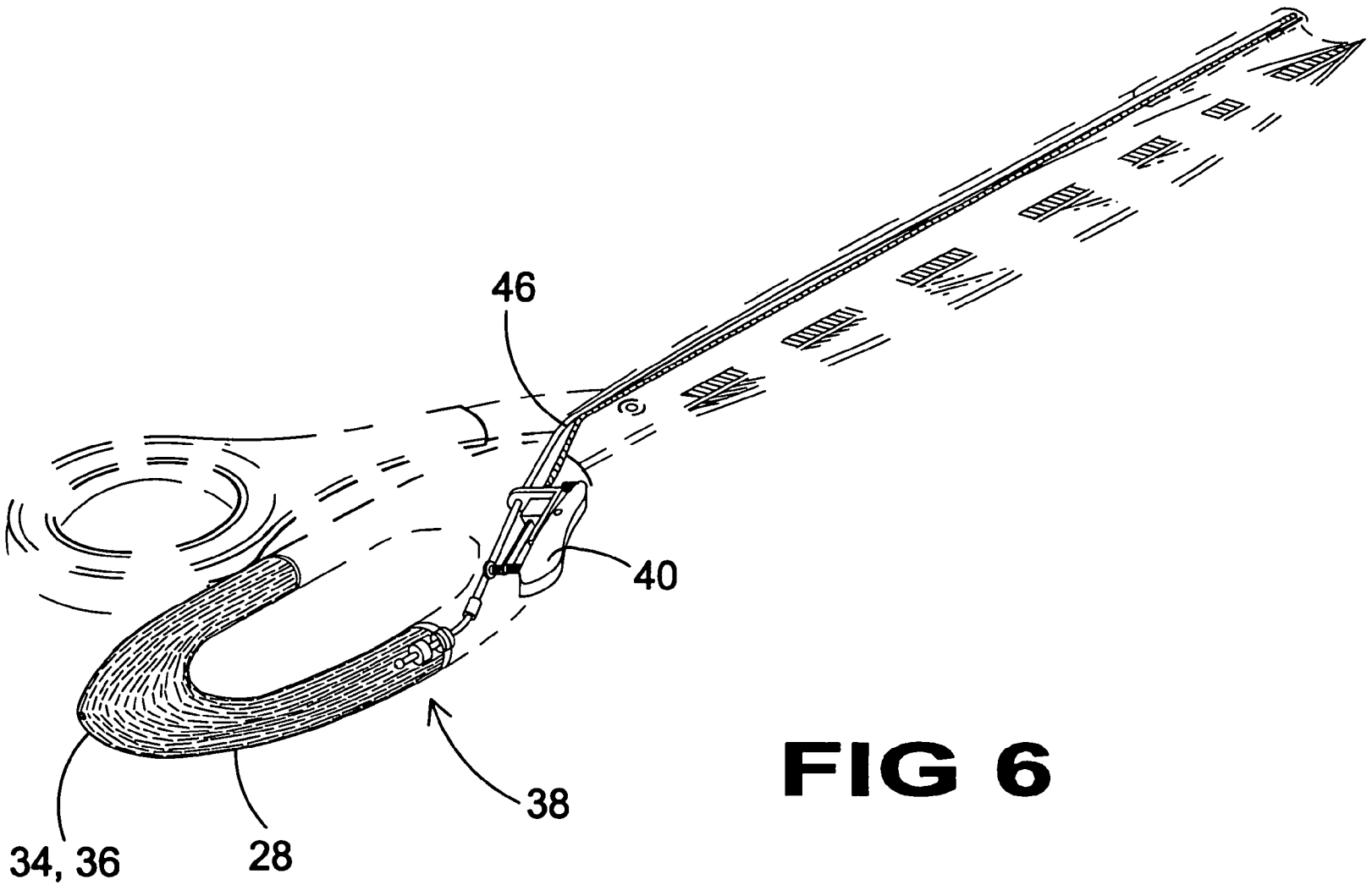
FIG. 6 is a perspective view of the present invention.

Turning to FIG. 6, shown therein is a perspective view of the present invention 10. Shown in outline is the scissors having pivotally engaging blades. Wherein one blade having a handle 28 at one distal end has the lighter mechanism contained therein. The lighter comprising a quantity of lighter fluid 34 contained within a chamber 36 having a release valve 38, normally in the closed position, connected to an igniter switch 40 located on the exterior forward section of the handle 28. Other previously disclosed elements are also shown.

Figure 7:
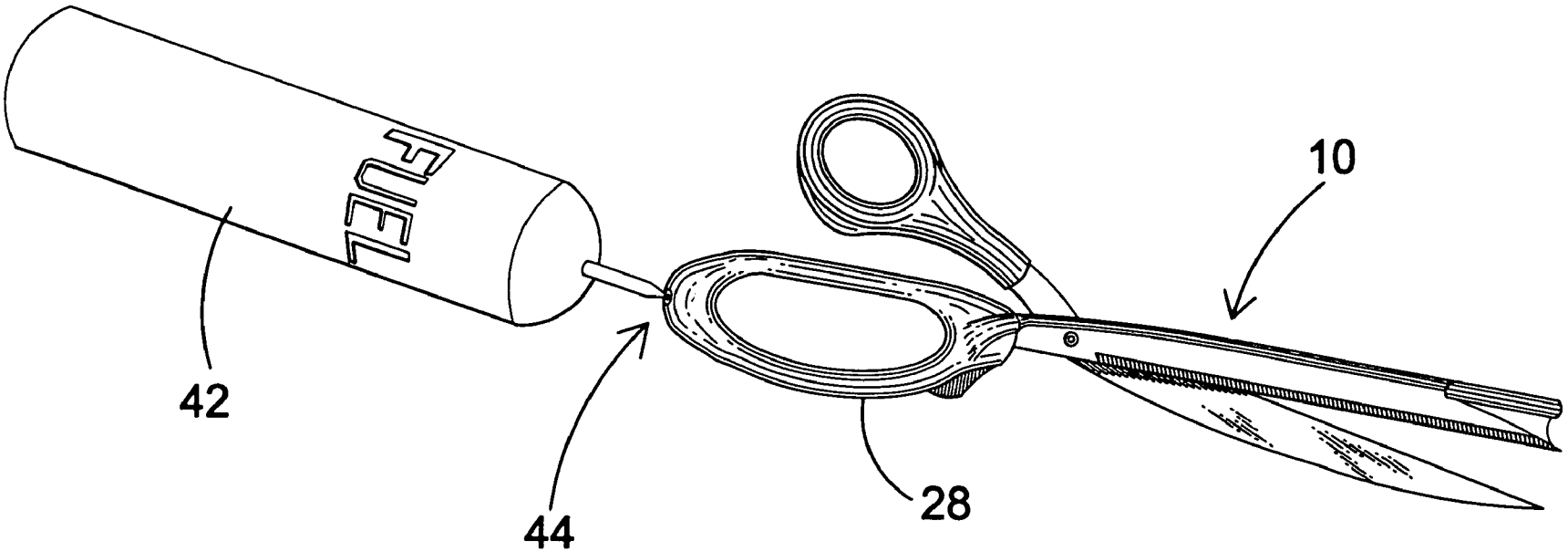
FIG. 7 is an illustrative view of the present invention wherein the chamber located within the handle is being refilled by inserting a gas canister having an appropriate fitting into the input port located in the handle.

Turning to FIG. 7, shown therein is an illustrative view of the present invention 10 wherein the chamber located within the handle 28 is being refilled by inserting a gas canister 42 having an appropriate fitting into the input port 44 located in the handle.

I claim:

1. An apparatus providing a combination scissors and lighter for cutting and sealing fibers, comprising:

a) a first and second blade each having first and second ends, a pivot pin joining said first and second blades for providing scissors;

b) a handle being disposed on each said first end of each said first and second blade, wherein said handles are sized to receive the fingers of a user;

c) an edge portion being disposed on each said first and second blade so that said edges lie on a common plane when said first and second blades are closed; and, d) a lighter in said scissors for producing a flame projecting from the second end of one blade to contact directly and seal ends of said fibers after being cut by said scissors.

2. The apparatus of claim 1, wherein said pivot pin is disposed on a substantially central axis of said first and second blade.

3. The apparatus of claim 2, wherein said edge portions are sharpened for cutting.

4. The apparatus of claim 3, wherein said first handle is larger than said second handle, wherein said first handle can receive a plurality of fingers of a user.

5. The apparatus of claim 4, wherein said a lighter comprises:

a) a fluid storage chamber being disposed in said first handle;

b) a fluid conduit having a first end connected to said fluid storage chamber and a second end terminating at a tip of said second end of said first blade;

c) an igniter switch being disposed adjacent said first end of said fluid conduit so that when said igniter switch is activated by a user said fluid is transmitted through said conduit to said second end of said fluid conduit; and, d) a means for sending an igniter spark being disposed adjacent said first end of said fluid conduit whereby a spark is sent to said second end of said fluid conduit so as to ignite the fluid when said igniter switch is activated.

6. The apparatus of claim 5, further comprising a fluid input port being disposed on said first handle for introducing fluid into said first handle.

7. The apparatus of claim 6, further comprising an output valve being disposed in said fluid storage chamber on said first end of said fluid conduit to permit fluid to flow out of said fluid storage chamber to said fluid conduit when said igniter switch is activated.

8. The apparatus of claim 7, wherein when said igniter switch is activated said output valve is opened thereby allowing fluid to flow through said conduit.

* * * * *